United States Patent [19]

Augurelli

[11] Patent Number: 4,946,313

[45] Date of Patent: Aug. 7, 1990

[54] VARIABLE-TRIM JACKET FOR SUBAQUEOUS USE

[75] Inventor: Benito Augurelli, Bologna, Italy

[73] Assignee: Free Shark Italia S.R.L., Bologna, Italy

[21] Appl. No.: 305,368

[22] Filed: Feb. 1, 1989

[30] Foreign Application Priority Data

Nov. 25, 1988 [IT] Italy ..... 3674 A/88

[51] Int. Cl.[5] ..... B63C 11/08

[52] U.S. Cl. ..... 405/186; 441/106

[58] Field of Search ..... 405/186, 185; 2/2.1 R; 441/88, 92, 96, 106, 108, 114, 115, 117, 119

[56] References Cited

U.S. PATENT DOCUMENTS 3,877,098 4/1975 Braly ..... 405/186
4,016,616 4/1977 Walters ..... 405/186
4,051,846 10/1977 McClure ..... 405/186 X
4,561,853 12/1985 Faulconer et al. ..... 441/106
4,752,263 6/1988 Pritchard et al. ..... 441/88
4,778,307 10/1988 Faulconer ..... 405/186
4,810,134 3/1989 Faulconer et al. ..... 405/186

*Primary Examiner*—David H. Corbin
*Attorney, Agent, or Firm*—Hoffmann & Baron

[57] ABSTRACT

The variable-trim jacket for subaqueous use is equipped with an outer air bag partially fastened to the jacket. The jacket is provided, in either or both of its side areas designed to wrap up the diver's abdomen, with at least a pocket adapted to freely hold respective flaps which form a portion the air bag. Flaps are free to slide outwardly or inwardly in relation to the pockets, with the sliding being due to the adjustment variations in the configuration of the flaps, occasioned as a result of an increase or decrease in volume of the survival gas introduced into or evacuted from the air bag.

3 Claims, 2 Drawing Sheets

VARIABLE-TRIM JACKET FOR SUBAQUEOUS USE

FIELD OF INVENTION

The present invention relates to adjustable variable-trim jackets for subaqueous use in connection with a diver's self-contained survival bottle containing survival gas.

BACKGROUND OF THE INVENTION

The present invention relates to an improved variable-trim jacket for subaqueous use, of the type consisting of a garment made of soft material such as a waterproof cloth partially wrapping up the diver's trunk and forming the support element for an air bag to be applied to the inside of the garment or being formed with the garment itself, and adapted to be connected to the self-contained survival gas-bottles carried by the diver.

DESCRIPTION OF THE PRIOR ART

Presently these types of variable-trim jackets are commonly used by divers in order to adjust their hydrodynamic trim according to the diving depth. Said adjustment takes place by deviating, with the use of suitable valves, part of the survival gas contained in said breathing bottles into the above mentioned air bag which, being inflated and deflated, allows the diver, taking into account the depth, to adjust his weight to the hydrodynamic thrust exerted on his body, and therefore his trim as well.

In spite of its clear usefulness, this accessory has shown drawbacks as regards its structure and practical use.

Firstly, difficulties have been found in assembling the air bag, when the latter is located at the inside of the garment (double bag jackets) and in connecting said air bag to the bottles through the cloth-made support forming the garment. Said assembling is carried out by a series of fastening lines of stitching between the air bag and the garment and the air bag and the connecting means to the bottles. Said stitchings make it necessary to perform a series of small weldings too in the regions close to the switchings themselves in order to seal the air bag and make it air-tight. These weldings give rise to weaker points on the air bag which, being continuously in contact with water and being submitted to pressures due to a continuous volume variation in circumscribed areas, can cause leaks in the air bag.

Secondly, a practical drawback encountered in the use of this type of jackets is due to the fact that the construction and particular arrangement of the air bag leads the diver to find a solution of compromise at the moment of wearing the jacket and fastening it to his abdomen. Practically the user must previously calculate the variation in extension that the air bag is going to undergo in its trim condition so that he will not be squashed by the increase in volume of the air bag or the jacket will not be caused to slide sideways as a result of the deflation of the bag itself, said sliding being above all due to the weight of the bottles in the event of sudden movements carried out by the diver, which movements would be dangerous to him.

SUMMARY OF THE INVENTION

It is an object of the present invention to eliminate the above mentioned drawbacks by providing a variable-trim jacket, substantially of the double-bag type, adapted to be worn without being obliged to take previously into consideration the subsequent size variations of the same as a result of the variation in volume of the air bag in its trim conditions.

The invention, as it is characterized by the claims, is provided with an outer air bag partially fastened to the garment which, in either of its side areas designed to wrap up the diver's adbomen, is provided with at least a pocket adapted to partially and freely contain respective flaps belonging to the air bag. Therefore the air bag flaps are free to slide outwardly or inwardly in relation to said pockets, the sliding being due to the adjustment variations in configuration, as a result of an increase or decrease in volume of the survival gas introduced into or evacuated from said air bag.

BRIEF DESCRIPTION OF THE DRAWINGS

The invention is set forth in greater detail hereinafter with the aid of the accompanying drawings showing a non-limiting embodiment thereof, given by way of example only. In the drawings.

DESCRIPTION OF THE PREFERRED EMBODIMENT

Figure 2:
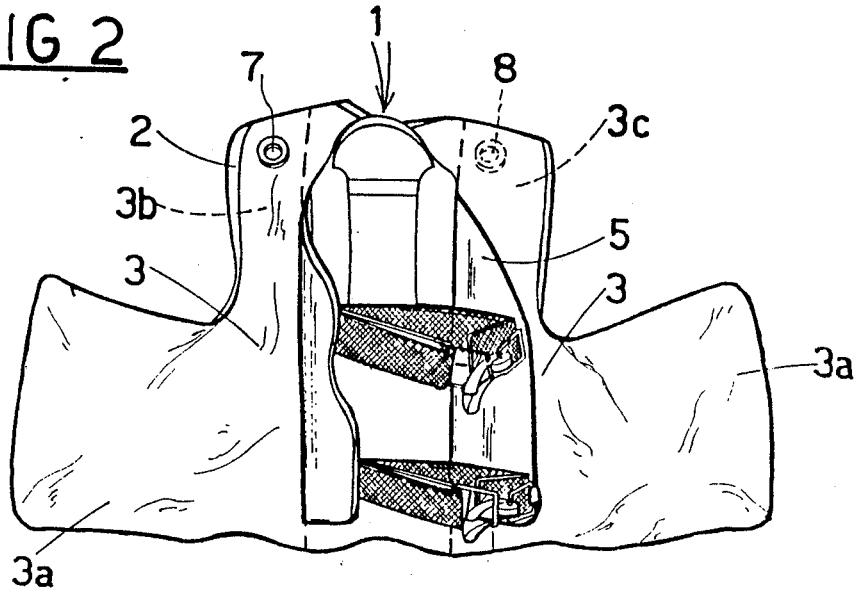
FIG. 2 is a rear view of the invention wherein a possible alternative embodiment is shown in dotted line, with the self-contained survival gas bottle removed from the bottle support element.

In conformity with the invention (see the accompanying figures) the variable-trim jacket generally identified by reference numeral 1 consists of a garment made of soft cloth tissue and forming the support element for an air bag 3 fastened to said garment on the outer and rear side thereof so as to exactly copy the outline of the same, as shown in FIG. 2. Said air bag is also disposed intermediate the garment 2 and a support element 5 of known type designed to hold and support bottles 15.

In the example shown in the drawings, garment 2 is provided with two pockets 4 fastened thereto at either of its side areas **2*a* and 2*b* and designed to wrap up the diver's abdomen, said pockets partially accommodating a flap 3*a* being part of said air bag 3** and extending therefrom.

Figure 1:
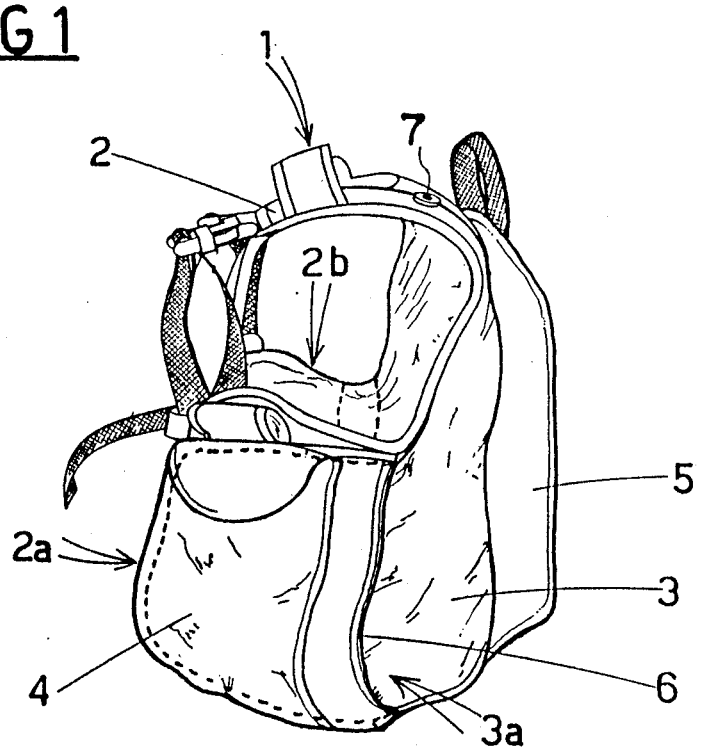
FIG. 1 is a perspective view of the invention.
Figure 4:
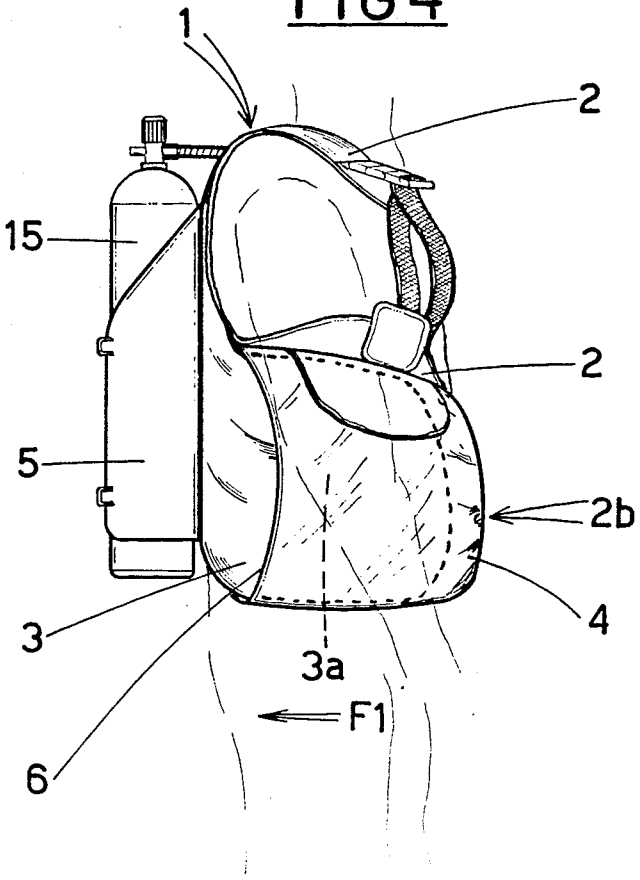
FIG. 4 is a side view of the invention wherein the air bag flaps are in their intermediate-operating condition.
Figure 3:
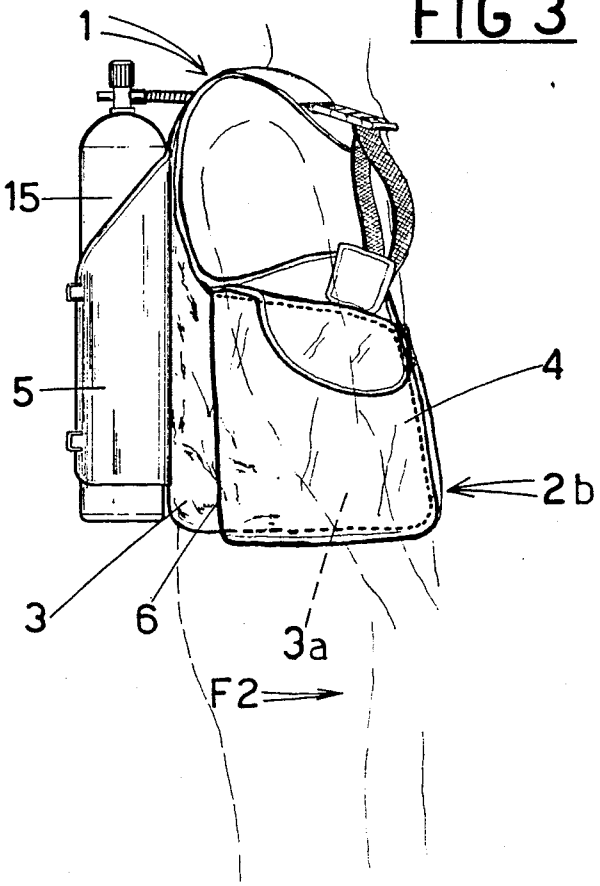
FIG. 3 is a side view of the invention wherein the flaps of the air bag are shown in their rest position.

Said flaps **3*a* (see in dotted line in FIGS. 1, 3 and 4) are fitted into pockets 4 through an opening 6 exhibited by the latter on a side thereof extending longitudinally and facing the rear part of jacket 1. As shown in FIGS. 3 and 4, flaps 3*a* housed in pockets 4 are free to move outwardly (see arrow F1) or inwardly relative to pockets 4 (see arrow F2) depending upon their configuration adjustment caused by the variation in volume of the survival gas introduced into or released from said flaps. Said variation is a result of the introduction or withdrawal of the survival gas contained in bottles 15 into the air bag 3 by way of gas valve 7 illustrated in FIG. 1 and does not at all affect the adhering and fastening configuration of garment 2** relative to the diver's body.

Shown in dotted line in FIG. 2 is a possible alternative embodiment of jacket 1, in which the air bag 3 is symmetrically divided into two distinct sections **3*b* and 3*c* separated from each other. In such an embodiment shown in FIG. 2, a pair of gas valves 7 and 8 respectively are provided to the two distinct and divided sections of the air bag 3, for introduction and evacuation of gas, in a manner described hereinabove. Said sections 3***b* and 3*c*, along their edge opposite that from which the respective flaps 3*a* extend, are fastened to garment 2 in the vicinity of the support element 5 for bottles 15.

The invention as conceived is susceptible of many modifications and variations, all falling within the scope of the inventive idea characterizing it. In addition, all of the details may be replaced by technically equivalent elements.

What is claimed is:

1. An improved variable-trim jacket for subaqueous use in connection with a diver's self-contained survival bottle or bottles containing a survival gas, said variable-trim jacket comprising:

a garment made of soft material and partially wrapping up the diver's trunk, and having side areas designed to wrap up said diver's abdomen; and an air bag to be applied to or being formed with the garment itself, and adapted to be connected to at least one of the diver's self-contained survival gas-bottles, said air bag being partially fastened to said garment and being capable of receiving a variable volume of survival gas from said self-contained survival bottle, said garment being provided in either or both of its side areas, with at least a pocket adapted to freely hold respective flaps forming a portion of said air bag said flaps being free to slide outwardly or inwardly in relation to said pockets, the sliding being due to the adjustment variations in the configuration of said flaps, as a result of an increase or decrease in volume of the survival gas introduced into or evacuated from said air bag.

2. The variable-trim jacket as claimed in claim 1, wherein said air bag is fastened to the rear part of the garment and disposed intermediate the latter and a support element designed to hold the diver's bottles.

3. The variable-trim jacket as claimed in claim 1, wherein said air bag consists of two distinct sections separated from each other, said sections along their edge opposite that from which the respective flaps extend, being fastened to the garment in the vicinity of said support element.

* * * * *